US009072963B2

(12) United States Patent
Antonopoulos

(10) Patent No.: US 9,072,963 B2
(45) Date of Patent: Jul. 7, 2015

(54) LOTTERY GAME SYSTEM AND METHOD OF PLAYING

(75) Inventor: Constantinos Antonopoulos, Athens (GR)

(73) Assignee: Intralot International Limited

( * ) Notice: Subject to any disclaimer, the term of this patent is extended or adjusted under 35 U.S.C. 154(b) by 0 days.

(21) Appl. No.: 13/183,519

(22) Filed: Jul. 15, 2011

(65) Prior Publication Data

US 2012/0135793 A1 May 31, 2012

Related U.S. Application Data

(60) Provisional application No. 61/417,914, filed on Nov. 30, 2010.

(51) Int. Cl.

| | |
|---|---|
| ***A63F 3/06*** | (2006.01) |
| *G07C 15/00* | (2006.01) |
| *G07F 17/32* | (2006.01) |

(Continued)

(52) U.S. Cl.

CPC ..... *A63F 3/0605* (2013.01); *G07C 15/005* (2013.01); *Y10S 283/903* (2013.01); *G07F 17/329* (2013.01); *A63F 3/00097* (2013.01); *A63F 3/065* (2013.01); *A63F 3/068* (2013.01); *A63F 2009/0659* (2013.01); *A63F 2009/2402* (2013.01)

(58) Field of Classification Search

CPC . A63F 3/0605; A63F 9/0078; A63F 3/00097; Y10S 283/903; G07C 15/00; G07C 15/005

USPC ..... 463/17

See application file for complete search history.

(56) References Cited

U.S. PATENT DOCUMENTS 3,731,933 A * 5/1973 Grant ..... 273/113
4,103,895 A * 8/1978 Pressman et al. ..... 463/15

(Continued)

FOREIGN PATENT DOCUMENTS

FR 2603496 A1 3/1988
WO 2007/021724 2/2007

OTHER PUBLICATIONS

European Patent Office, The International Search Report and the Written Opinion of the International Searching Authority, or the Declaration; PCT/US2011/056086, Jan. 17, 2012, 12 pages.

(Continued)

*Primary Examiner* — Bach Hoang
*Assistant Examiner* — Anh Vo V Nguyen
(74) *Attorney, Agent, or Firm* — Wood, Herron & Evans, LLP

(57) ABSTRACT

A lottery game system includes a number of lottery tickets, a playing area disposed on each lottery ticket, the playing area having a number of paths each traversing in the playing area. A starting point and an end point are disposed on the playing area. A winning predetermined path begins at the starting point and ends at the end point and is initially concealed from a player prior to commencing play of the lottery game. A special point is disposed among the various paths is positioned before the end point. The lottery game system may further include a lottery wand manipulated by a user wherein the lottery wand remains in contact with said lottery ticket along said winning path. Further, the lottery game system may include at least one lottery terminal which is operative to print at least one playing area and to dispense at least one lottery ticket.

18 Claims, 3 Drawing Sheets

(51) Int. Cl.

| | |
|---|---|
| *A63F 3/00* | (2006.01) |
| *A63F 9/06* | (2006.01) |
| *A63F 9/24* | (2006.01) |

(56) References Cited

U.S. PATENT DOCUMENTS

| | | | | |
|---|---|---|---|---|
| 4,288,537 | A * | 9/1981 | Knetzger | 434/169 |
| 4,465,283 | A * | 8/1984 | Pilette et al. | 273/249 |
| 4,511,143 | A * | 4/1985 | Sankrithi | 273/153 R |
| 4,604,065 | A * | 8/1986 | Frazer et al. | 434/331 |
| 5,411,260 | A | 5/1995 | Smith | |
| 5,855,514 | A * | 1/1999 | Kamille | 463/17 |
| 6,409,513 | B1 * | 6/2002 | Kawamura et al. | 434/178 |
| 6,676,126 | B1 | 1/2004 | Walker et al. | |
| 6,761,633 | B2 | 7/2004 | Riendeau et al. | |
| 7,527,266 | B1 * | 5/2009 | Laiti | 273/282.1 |
| 7,699,314 | B2 | 4/2010 | Bozeman | |
| 7,726,652 | B2 | 6/2010 | Jubinville et al. | |
| 8,011,662 | B2 * | 9/2011 | Black | 273/153 R |
| 8,221,213 | B2 | 7/2012 | Martineck, Sr. | |
| 2002/0076684 | A1 * | 6/2002 | Blevins et al. | 434/322 |
| 2004/0254019 | A1 | 12/2004 | Riendeau et al. | |
| 2005/0250574 | A1 | 11/2005 | Kane et al. | |
| 2006/0151943 | A1 * | 7/2006 | Bozeman | 273/138.1 |
| 2006/0157554 | A1 * | 7/2006 | Halbur et al. | 235/380 |
| 2006/0258451 | A1 * | 11/2006 | Yang | 463/36 |
| 2007/0004492 | A1 * | 1/2007 | Salmento | 463/15 |
| 2008/0083015 | A1 * | 4/2008 | Kim | 726/2 |
| 2008/0234045 | A1 * | 9/2008 | Mezen | 463/37 |
| 2009/0121474 | A1 * | 5/2009 | Hughes | 283/100 |
| 2009/0295734 | A1 * | 12/2009 | Hendrickson et al. | 345/169 |
| 2010/0167805 | A1 | 7/2010 | Martineck, Sr. | |
| 2010/0167806 | A1 | 7/2010 | Martineck, Sr. | |
| 2011/0009177 | A1 * | 1/2011 | Katz et al. | 463/17 |

OTHER PUBLICATIONS

European Patent Office, Notification of Transmittal of the International Preliminary Report on Patentability, PCT/US2011/056086, Nov. 16, 2012, 15 pgs.

* cited by examiner

LOTTERY GAME SYSTEM AND METHOD OF PLAYING

This claims the benefit of U.S. Provisional Application Ser. No. 61/417,914, filed Nov. 30, 2010 and hereby incorporated by reference in its entirety.

BACKGROUND OF THE INVENTION

This invention generally relates to a lottery game system, and more particularly, to a lottery game where the skill of a user determines the outcome.

There are many "instant-win" lottery games which players can buy and subsequently play at point-of-sale lottery locations. Many of the instant-win lottery games in the prior art are embodied in a ticket having a surface which the player must "scratch-off" in order to play the game. Moreover, many instant-win lottery games are meant to play electronically on a computer via the internet. Although many of the games in the prior art require active participation by the user, such as scratching off the surface, playing the games in the prior art does not require a player to use skill or coordination. These games are based on chance; players are required only to guess as to the correct portions of a ticket to "scratch-off," for example, in order to reveal winning indicia.

Moreover, the games in the prior art typically involve a fixed stake amount. The lottery game tickets in the prior art may be sold at a fixed price, for example, two dollars, and have a predetermined winning amount, known as fixed odds. Players may not increase their wagers in order to raise the potential winning amount. Furthermore, players typically may not request an increase or decrease in the level of difficulty of the lottery game. Finally, games in the prior art do not have time limits. Players typically may take as much time as is desired in order to complete the game on the lottery ticket or electronic medium such as a computer.

SUMMARY OF THE INVENTION

It is an object of this invention to provide a lottery game system and method for conducting a lottery game. This invention relates to a lottery game system and method meant to be played at point-of-sale locations using lottery tickets. A player traverses a path on the lottery ticket which may include using a special purpose lottery terminal, lottery wand, or wand-like device. Although there is a predetermined path that the player must follow, the player must use skill and coordination in order to guess the correct path, for example, by connecting dots in a "snake" shape or traversing a maze on a lottery ticket. The player may request a certain difficulty and accordingly may adjust his or her wager. Although the game is "fixed odds," adjusting the difficulty (and thus the wager) results in higher potential winnings, adding to the excitement of the game for the player. Further adding to the excitement of the game and providing an element of suspense, the player must complete the game in a certain period of time. Providing a time limit further requires the player to think ahead and use skill in playing the game.

The invention in various aspects is embodied in a lottery ticket and associated lottery game. A prospective player participates in the lottery game by purchasing a lottery ticket from a retailer. The player selects a level of difficulty with which he wishes to participate and advises the retailer on the stake amount he desires. The retailer then prints a ticket fulfilling the player's choices and informs the player about his potential winnings. The player is given a specified time in which to start and finish the lottery game. The player in one embodiment of the invention starts the game by using a special purpose lottery terminal on a playing area of the ticket. The special purpose lottery terminal may be a STYLOT™, manufactured by Intralot (www.Intralot.com). The player then traverses the playing area on the ticket using the special purpose lottery terminal or other instrument or device as appropriate. The player loses, or does not win, when the player lifts the instrument from the ticket, does not complete the game before the allotted time has run or the player fails to follow one of the rules.

A lottery ticket is also provided, which includes a playing area, a number of paths traversing in the playing area, a starting point and an end point disposed on the playing area, and a first winning, predetermined path beginning at the starting point and ending at the end point, wherein the first winning path is initially concealed to the player prior to commencing play of the lottery ticket. In an alternative embodiment, the lottery ticket additionally has a special point disposed among the plurality of paths and a second winning path, defined as a portion of the first winning path, wherein the portion beings at the starting point and ends at the special point before the finishing point.

A method for playing a lottery game includes supplying a player with at least one lottery ticket including a playing area having a number of paths, including a first winning path having a single, predetermined path among the variety of paths. The winning path is unknown to the player and allows the player to attempt to reach the end of the path and win the game by tracing a path among the various paths. In an alternative embodiment, the method also includes printing at least one playing area on the lottery ticket and dispensing the lottery ticket to the user. In another alternative embodiment, the method also includes defining a special point disposed among the various paths and defining a second winning path as a portion of the first winning path. In yet another alternative embodiment, the method for playing a lottery game also includes defining a subset of said lottery tickets on which the playing area has a greater number of paths than a remainder of the lottery tickets to thereby increase a level of difficulty of playing the subset of lottery tickets. In yet another embodiment, the method includes defining a first winning amount according to the first winning path and a second winning amount according to the second winning path, wherein the first winning amount is greater than said second winning amount.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
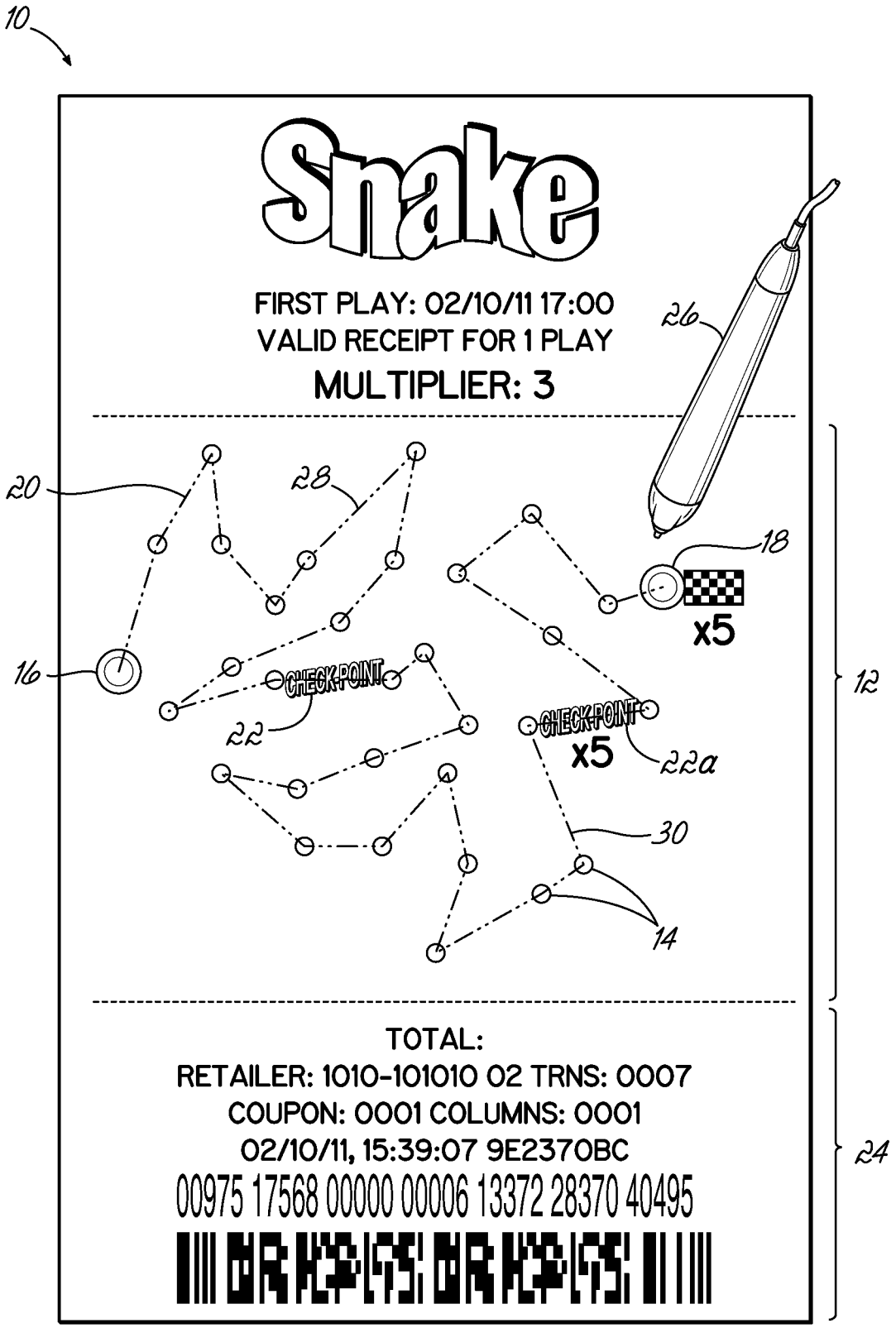
FIG. 1 is a front planar view of an embodiment of a lottery ticket including a playing area with a plurality of dots on the playing area.

Referring to FIG. 1, one embodiment of a lottery ticket 10 as part of a lottery game system according to this invention is shown. The ticket 10 includes a playing area 12 with a number of playing indicia 14 such as dots, a starting point 16 and an end point 18. A first winning, predetermined path 20 is shown between the starting point 16 and end point 18 connecting each of the various dots 14 in the playing area 12. It is appreciated that there are many alternative, but non-winning paths possible which also connect the dots and which begins at the starting point and end at the end point 18. The dots 14 are randomly generated on the playing area 12 by a lottery terminal and printed on the lottery ticket 10 accordingly. This version of the game may resemble a snake winding through the playing area 12. The playing area 12 also includes at least one special point (two of which are shown in FIG. 1) along the winning path, denoted as "CHECK POINT" 22, 22*a* in FIG. 1. The ticket 10 also contains at least one ticket identifying portion 24 having information identifying the game, time, date, and other information necessary to lottery play and compliance with state or other regulations.

A player may start the game by placing a tool, instrument or special purpose lottery terminal wand 26 on the starting point 16. To win, the player must traverse the playing area 12, connect the dots 14 in the predetermined, winning path 20 to the end point 18. The player must begin the game within a certain period of time after being issued the ticket 10 and must finish the game within a certain period of time after starting the game. A second winning path 28 may also be provided, and is defined as a portion of the first winning path 20. The second winning path 28 also begins at the starting point 16, coincides initially with the first winning path and ends before the end point 18 at the special or check point 22. In FIG. 1, an additional, second special or check point 22*a* is shown, providing at least a third winning path 30 beginning at starting point 16, traversing the predetermined path 20 initially and ending at second special point 22*a*. In each winning path in this embodiment denoted as a snake game in FIG. 1, each predetermined path passes through each dot 14 on the playing area 12 only one time. The respective path 20, 28, 30 must not pass through the same line between two dots 14 more than once. There may be more than one, two or three winning paths and this specification is not meant to limit this amount.

More specifically, to win the maximum amount for the game, the player must traverse the first winning path 20 on the playing area 12 of the lottery ticket 10. The winning path 20 is predetermined when the playing area 12 on the ticket 10 is printed, and is initially concealed to the player. Throughout this specification, the terms "the winning path," "the predetermined path" and "first winning path" are used interchangeably and are meant to indicate the path on the lottery ticket 10 which the player must follow to win the game. To start the game, in one embodiment the player may place a special purpose lottery terminal stylus or wand 26, one example of which is a STYLOT™ offered by Intralot (www.Intralot-.com) on the starting point 16 of the playing area 12, which may be graphically represented, for example, as a large "button" or dot shape containing the word "start." The player, while keeping the special purpose lottery wand 26 in contact with the surface of the lottery ticket 10, traverses the playing area 12 and connecting the dots 14 until he reaches the end point 18. The end point 18, similar to the starting point 16, may be graphically represented on the lottery ticket 10, for example, as a large button, a dot shape containing the word "end" or as a flag. There are many paths between the starting point 16 and end point 18 that the player may traverse while playing the game, with only one or a select few being the winning path 20. The player must use skill and guess-work to select the winning path. When the player wins, he may receive a predetermined winning amount, which is determined by the stakes desired or chosen by the player and the difficulty of the game. In another embodiment of this invention, the game is played without the wand, and another instrument or tool may be used to delineate the path chosen by the player, examples being a pencil or pen, scratching off of a cover portion of the ticket 10 to reveal the chosen path, etc. If the game is played in this manner, the ticket 10 may be returned to the lottery retailer or agent to determine and verify the results of the lottery game via a scan of the ticket or another mode of inspection.

Figure 3:
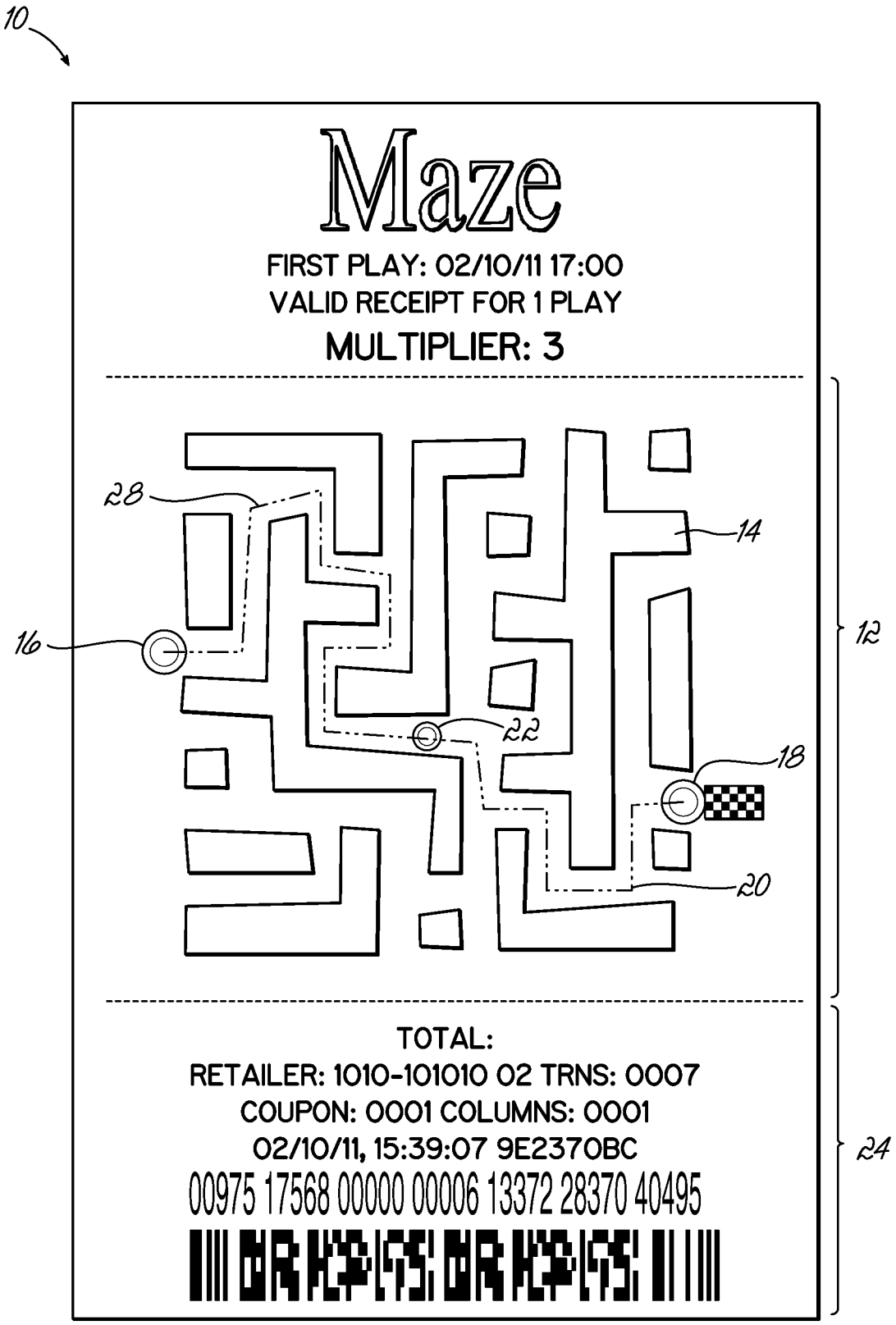
FIG. 3 is a front planar view of an alternative embodiment of a lottery ticket including a playing area with a maze on the playing area.

Referring to FIG. 3, an alternative embodiment of a lottery ticket 10 is shown, having a playing area 12 with a starting point 16, an end point 18, and playing indicia 14 in the form of a maze. The winning, predetermined path 20 is shown. The ticket 10 also contains at least one ticket identifying portion 24 having information identifying the game, time, date, and other information necessary to lottery play and regulation. To win, the player must traverse the playing area 12 in the predetermined, winning path 20 to the end point 18. The player must begin the game within a certain period of time after being issued the ticket 10 and must finish the game within a certain period of time after starting the game. In each winning path 20, the path does not reach a dead end, does not double-back on itself, or run into a wall.

In various embodiments, there is at least one additional winning path, hereinafter also referred to as "second winning path," "second path" or "additional path," defined as a portion of the winning predetermined path, which the player may traverse in order to win. The end of these additional paths may be denoted by special points 22, 22*a*, for example, "checkpoints," on the playing area. Because it will be less difficult for the user to traverse the playing area to the checkpoints 22, 22*a* than to the finishing point, the potential winning amount for reaching a checkpoint along the additional path 28 will be less than for reaching the end point 18. In the dots or snake embodiment of FIG. 1, for example, a checkpoint 22 may be denoted as one of the dots and labeled "checkpoint" or may be represented as a special dot having a different design than the remainder of the dots, or both. It should be understood that "special point" and "checkpoint" are used interchangeably in this specification.

In the dots or snake embodiment of FIG. 1, each predetermined path 20 passes through each dot 14 on the playing area 12 only one time. The path 20 must not pass through the same line between two dots 14 more than once. These limitations on the path 20 traversal may also be considered "rules" of the game and may be referred to as such throughout this specification.

In each embodiment, a subset of lottery tickets 10 may be provided where the level of difficulty to complete the lottery game may be increased. The level of difficulty to traverse the correct winning path 20 may be increased by increasing the number of possible paths to be traversed. In the dots or snake embodiment of FIG. 1, this may be accomplished by increasing the amount of dots 14 which are printed on the playing area 12, thereby increasing the amount of possible paths that the user may choose from. In the maze embodiment of FIG. 3, the level of difficulty may be increased by increasing the number of walls and "dead ends" included on the playing area 12, thereby increasing the amount of possible paths that the user may traverse. In each embodiment, the level of difficulty determines the duration of the game. Preferably, the duration of the game does not exceed two minutes.

In an alternative embodiment, use of a "dedicated terminal" or dedicated lottery terminal for the facilitation of playing lottery games and the avoidance of any queues with the point of sale is desired.

Reference to a "line" as referred to in this specification with respect to the dots embodiment is meant to refer to a segment between two dots or game indicia 14. The predetermined path that the player must traverse is not exact in the sense that the player fails to follow the winning path 20 if his lines are not perfectly straight or are overly straight. For example, in the dots embodiment of FIG. 1, a player must connect the dots 14 in a certain order to create the predetermined path, but he will not be penalized if the lines comprising the path are, for example, not perfectly straight. In the maze embodiment of FIG. 3, the path 20 also need not be exact in the same sense as described with respect to the dots embodiment. The player may be provided with one or more hints as to the winning path 20 at least one area on the playing area 12, which may be depicted as the mentioned checkpoints 22, 22*a*, or in an alternative way.

Figure 2:
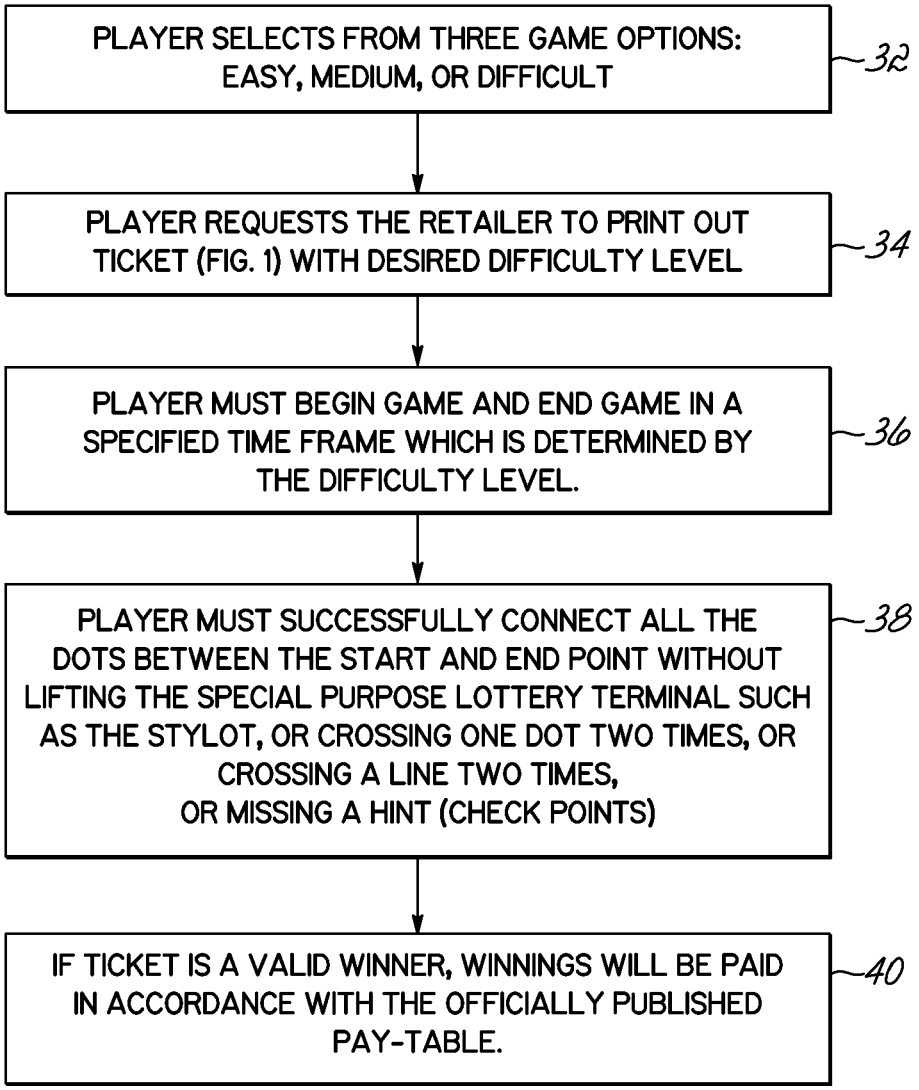
FIG. 2 is a flow chart of the steps according to one embodiment of this invention.

FIG. 2 shows a flow chart demonstrating that a player may select 32 from three levels of difficulty. The flow chart of FIG. 2 is for illustrative purposes and different embodiments of the invention may have more or less than three levels of difficulty. The player requests 34 a retailer to print out a ticket, such as that seen in FIG. 1 or FIG. 3, with the player's desired difficulty level. The ticket 10 may be printed with any appropriate printer of lottery ticket paper, including a laser or other printer, although a thermal printer may not be compatible with the wand 26. Certain rules of embodiments of this invention may require the player to begin 36 the game in a specified time frame after receiving the ticket and also finish the game in a specified time frame after starting. These time frames are determined by the chosen difficulty level. The period of time in which the player must finish the game preferably does not exceed two minutes. This amount of time may be adjusted to exceed two minutes in order to adjust the difficulty of the lottery games upon the finding that two minutes is too difficult for players, for example. Because this invention is a game of skill, statistics will be kept in order to examine whether the levels of difficulty and periods of time in which to finish the games are appropriate for a certain desired player winning percentages. If players are winning games at a higher success rate than is desired, for example, levels of difficulty and periods of time allowed for play may be adjusted accordingly, and vice versa.

The selling period of the ticket will depend on the legal restrictions of the appropriate state or governmental entity. The player may participate in the game up to a specified closing sales time specified by the lottery authority of the appropriate state or governmental entity. The total cost of a ticket, or the participation value, is calculated by multiplying the single game value of the ticket times the stake selected. If the player wins as described in this specification, winnings will be paid in accordance with a to-be-published pay-table. Winners may claim their prizes within a predefined period of time. After the end of this period, any unclaimed prizes will be purged according to the existing rules of the lottery authority. A winner can win only one winning category, that is, the one with the highest winning amount. For example, a player traversing 38 the winning path from the start point to the finishing point is not also entitled to prizes for reaching the check points.

The lottery game is defined as "fixed odds," wherein a player knows in advance his or her potential winnings 40. In the dots or snake embodiment of FIG. 1, the winning amount for each winner of every game is fixed, regardless of the actual participants and number of winners of each draw.

Again referring to FIG. 2, the player must successfully traverse the winning path between the starting and finishing points without lifting the lottery wand, such as the STYLOT™, or failing to follow one of the rules, as noted previously in this specification. Another rule provided is that the player may lose if he or she "misses a hint." In one embodiment, one of the check points, as previously described in this specification, may act as a hint to the player as to whether he or she is following the correct path, in addition to being an end point of a second or third winning path, for example. However, a hint may be represented as something other than a check point on the playing area.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

I claim:

1. A lottery game system, comprising:

a plurality of lottery tickets;

a playing area disposed on each said lottery ticket;

a plurality of paths traversing in said playing area;

a single starting point and a single end point disposed on said playing area;

wherein each of the plurality of paths begins at the single starting point; and a single winning predetermined path beginning at said single starting point and ending at said single end point, wherein said single winning predetermined path is initially concealed from a player prior to commencing play of the lottery ticket;

wherein the player must traverse the single winning predetermined path within a certain period of time and the lottery game ends upon expiration of the certain period of time a special point disposed among said playing area, along said single winning predetermined path, and between said single starting point and said single end point;

wherein the player is awarded a first prize if the player traverses the single winning predetermined path from the single starting point to the single end point within the certain period of time;

wherein the player is awarded a second prize which is less than the first prize if the player reaches the special point, but not the single end point, within the certain period of time.

2. The lottery game system of claim 1, further comprising:

at least one lottery terminal, wherein said lottery terminal is operative to print said at least one playing area and to dispense said at least one lottery ticket.

3. The lottery game system of claim 1, further comprising:

a lottery wand manipulated by the user to traverse said playing area.

4. The lottery game system of claim 3, wherein said lottery wand remains in contact with said lottery ticket along said single winning predetermined path.

5. The lottery game system of claim 1, further comprising:

a subset of said plurality of lottery tickets on which said playing area has a greater number of paths than a remainder of said lottery tickets to thereby increase a level of difficulty of playing said subset of lottery tickets.

6. The lottery game system of claim 1 wherein said plurality of paths includes a series of dots sequentially traversed on said playing area between said single starting point and said single end point.

7. The lottery game of claim 6 wherein the number of said plurality of paths is increased by increasing a number of said dots.

8. The lottery game system of claim 1 wherein said plurality of paths are delineated by game indicia on the playing area and said game indicia further comprises:

at least one maze disposed on each said playing area, said maze having a plurality of passages and a plurality of walls; and wherein said single winning predetermined path traverses at least some of said plurality of passages.

9. The lottery game system of claim 8, further comprising:

a subset of said plurality of lottery tickets on which said playing area has a greater number of paths than a remainder of said lottery tickets to thereby increase a level of difficulty of playing said subset of lottery tickets; and wherein the number of paths is increased by increasing a number of at least one of said passages and said walls.

10. The lottery game system of claim 1 wherein each of the plurality of paths ends at the single end point.

11. The lottery game system of claim 1 wherein each of the plurality of paths share the single starting point.

12. A lottery game system, comprising:

a plurality of lottery tickets;

a playing area disposed on each said lottery ticket;

a plurality of paths traversing in said playing area;

a single starting point and a single end point disposed on said playing area;

wherein each of the plurality of paths begins at the single starting point and ends at the single end point;

a single winning predetermined path beginning at said starting point and ending at said end point wherein said single winning predetermined path is initially concealed from a player prior to commencing play of the lottery ticket;

wherein the player must traverse the single winning predetermined path within a certain period of time and the lottery game ends upon expiration of the certain period of time;

a special point disposed among said playing area, along said single winning predetermined path, and between said single starting point and said single end point;

wherein the player is awarded a first prize if the player traverses the single winning predetermined path from the single starting point to the single end point within the certain period of time;

wherein the player is awarded a second prize which is less than the first prize if the player reaches the special point, but not the single end point, within the certain period of time;

a lottery wand manipulated by the user to traverse said playing area, wherein said lottery wand remains in contact with said lottery ticket along said single winning predetermined path; and at least one lottery terminal, wherein said lottery terminal is operative to print said at least one playing area and to dispense said at least one lottery ticket.

13. A lottery ticket, comprising:

a playing area;

a plurality of paths traversing in said playing areal;

wherein each of the plurality of paths begins at a single starting point and ends at a single end point disposed on said playing area;

a single winning predetermined path beginning at said single starting point and ending at said single end point, wherein said single winning predetermined path is initially concealed to a player prior to commencing play of said lottery ticket; and a special point disposed among said playing area, along said single winning predetermined path, and between said single starting point and said single end point;

wherein the player must traverse the single winning predetermined path within a certain period of time and a lottery game associated with the lottery ticket ends upon expiration of the certain period of time;

wherein the player is awarded a first prize if the player traverses the single winning predetermined path from the single starting point to the single end point within the certain period of time;

wherein the player is awarded a second prize which is less than the first prize if the player reaches the special point, but not the single end point, within the certain period of time.

14. A method for playing a lottery game, comprising the steps of:

generating at least one lottery ticket including a playing area having a plurality of paths using a printer, all of the plurality of paths sharing a common starting point;

defining a single winning path among said plurality of paths, wherein the single winning path is unknown to the player;

supplying a player with the at least one lottery ticket;

allowing the player to attempt to pursue said single winning path by tracing a path among said plurality of paths;

defining a special point disposed among said playing area, along said single winning path, and between the starting point and an end point;

defining a certain period of time during which the player must complete the lottery game;

defining a first prize to the player finishing at said end point prior to the expiration of the certain period of time; and defining a second prize according to a player passing said special point, but not reaching the end point prior to the expiration of the certain period of time;

wherein said first prize is greater than said second prize.

15. The method of claim 14, further comprising:

dispensing said lottery ticket from a ticket dispenser.

16. The method of claim 14, further comprising:

printing a subset of said lottery tickets on which said playing area has a greater number of paths than a remainder of the lottery tickets to thereby increase a level of difficulty of playing the subset of lottery tickets.

17. The method of claim 14 further comprising:

indicating a desired difficulty level of a lottery game to a vendor; and receiving a lottery ticket from the vendor with desired difficulty level.

18. The method of claim 14 wherein the player traces the path with a wand manipulated by the player.

* * * * *